US006079055A

United States Patent [19]

Mencel

[11] Patent Number: 6,079,055

[45] Date of Patent: Jun. 27, 2000

[54] PROTECTIVE SHOULDER PAD

[75] Inventor: Kenneth G. Mencel, Bridgeport, Conn.

[73] Assignee: Ski-Eze Products International, Inc., Bridgeport, Conn.

[21] Appl. No.: 09/306,584

[22] Filed: May 6, 1999

[51] Int. Cl.[7] ..... A41D 27/26

[52] U.S. Cl. ..... 2/459; 2/45; 2/268; 2/310

[58] Field of Search ..... 2/459, 44, 45, 2/267, 268, 310, 326–328, 247; 224/259, 264, 265, 201; 602/61–63, 4–5, 19, 20

[56] References Cited

U.S. PATENT DOCUMENTS

| | | | |
|---|---|---|---|
| 3,504,377 | 4/1970 | Biggs et al. | 2/45 |
| 4,353,133 | 10/1982 | Williams | 2/45 |
| 4,784,128 | 11/1988 | Scheuermann | 128/165 |
| 5,181,906 | 1/1993 | Bauerfeind | 602/63 |
| 5,188,587 | 2/1993 | McGuirre et al. | 602/20 |
| 5,319,806 | 6/1994 | Hermann et al. | 2/44 |

*Primary Examiner*—John J. Calvert
*Assistant Examiner*—Tejash Patel
*Attorney, Agent, or Firm*—Fattibene & Fattibene; Arthur T. Fattibene; Paul A. Fattibene

[57] ABSTRACT

A protective shoulder pad which is adapted to be worn on either the right or left shoulder of a wearer for supporting a load, and which includes a protective pad having a band forming an underarm loop connected adjacent one side thereof, and a pair of body straps connected adjacent the opposite side of the protective pad with the free ends of the body strap having complementary fastening means for securing the free ends of the body straps in a readily releasable manner so that when worn, one arm of the wearer is slipped through the underarm loop with the body strap being diagonally extended along the back and front of the wearer so that the free ends are secured in a readily releasable manner on the front of the wearer.

6 Claims, 3 Drawing Sheets

PROTECTIVE SHOULDER PAD

FIELD OF THE INVENTION

This invention is directed generally to a shoulder pad, and more specifically to a protective shoulder pad for cushioning a load when carried on one's shoulder.

BACKGROUND OF THE INVENTION

Heretofore, it has been observed that when one is carrying a load comprising of generally elongated articles, e.g. skis, lumber, tools and other such types of loads, that it has been customary to support such elongated loads directly upon one's shoulder. Supporting such loads directly on one's shoulder results in the load bearing directly on one's shoulder blade, which can and does result in bruising or injury to the shoulder in the event such loads are required to be carried over long distances. It can be further appreciated that carrying such loads directly supported on one's shoulder is uncomfortable and fatiguing, which is aggravated proportional to the weight of the load as it is increased.

SUMMARY OF THE INVENTION

An object of this invention is to provide a simply constructed shoulder pad which is arranged to cushion the weight of a load when carried on one's shoulder.

Another object is to provide a protective shoulder pad which can be equally worn on either the left or right shoulder of a user.

Another object is to provide a protective shoulder pad which is readily simple in construction, easy to fabricate, and positive in operation.

Another object is to provide a shoulder pad which is pleasing in appearance, light in weight and simple to use.

The foregoing objects, features and other advantages are attained by a protective shoulder pad which includes an upper and lower planer sheet material which are suitably secured about the peripheral edges thereof to define a pocket for receiving a cushioning pillow or pad in the form of a rubber, foam or sponge like material which is sealed within the pocket. Connected between the opposed end portions of the pad adjacent the outer side of the pad is a band defining an underarm loop. Connected to the opposite side or corner portions of the pad is a body strap which is adapted to wrap around the body for positively retaining the pad on one's shoulder when in use. The ends of the respective body straps are provided with complementary fastening means to secure the opposed ends of the body straps when in use. The fastening means may comprise a complementary catch and latch type buckle which is rendered readily releasable.

IN THE DRAWINGS

DETAILED DESCRIPTION

Figure 1:
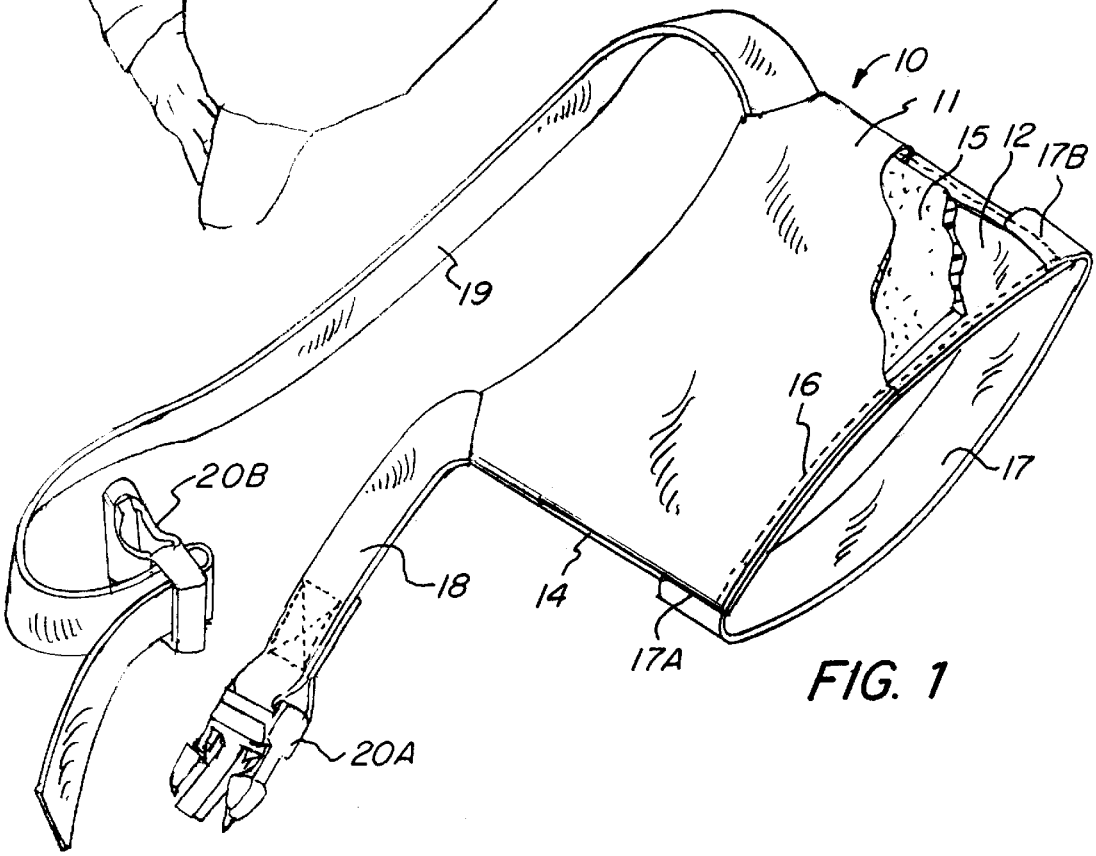
FIG. 1 is a perspective view of a protective shoulder pad embodying the invention.
Figure 3:
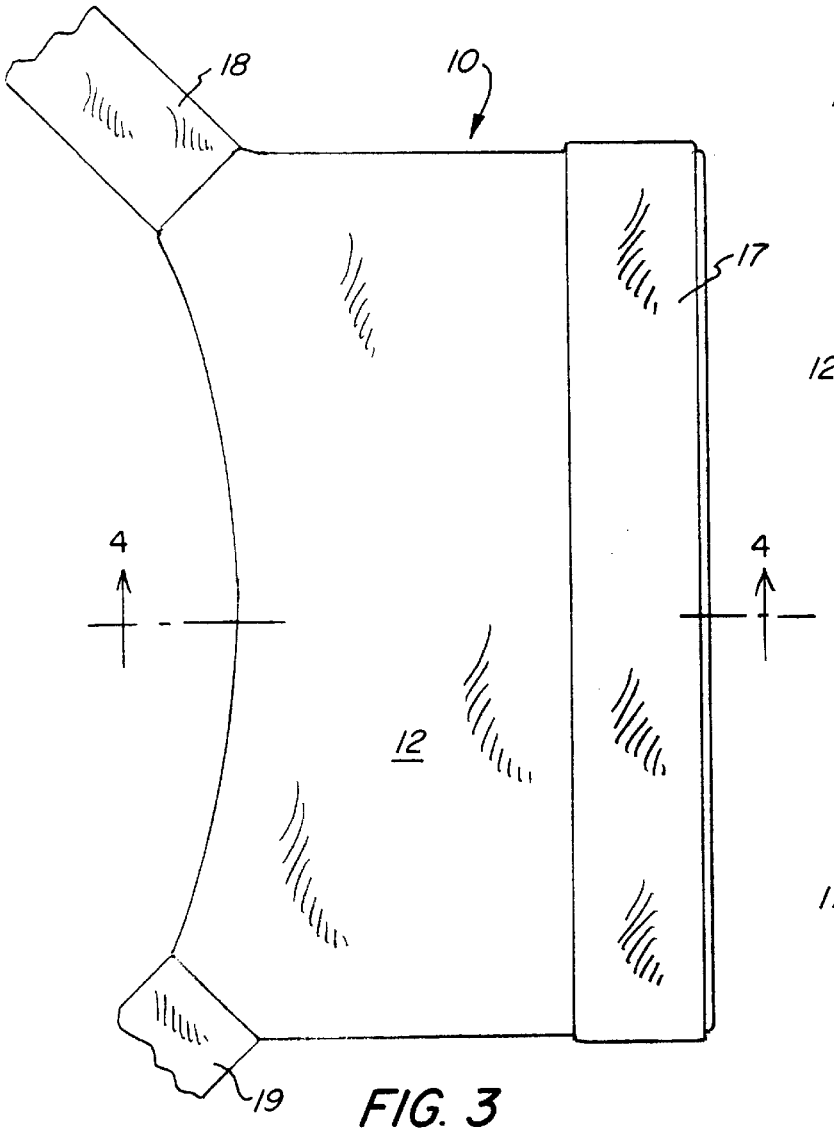
FIG. 3 is a fragmentary bottom plan view of the shoulder pad.
Figure 5:
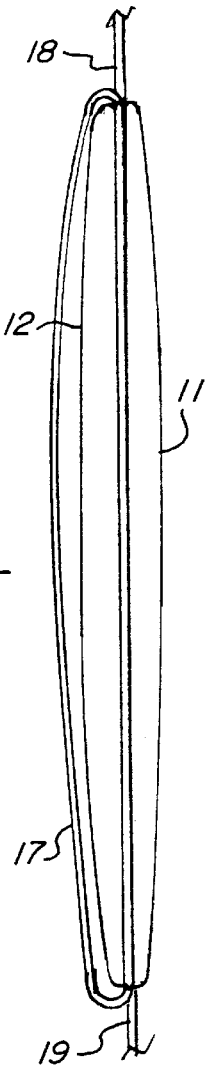
FIG. 5 is an end view of FIG. 3.
Figure 4:
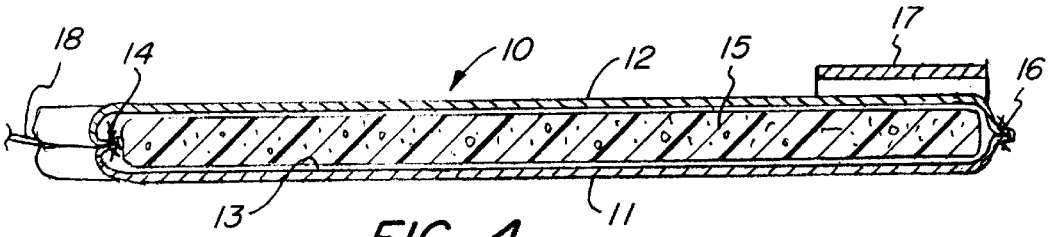
FIG. 4 is a sectional view taken along FIG. 4—4 on FIG. 3.

Referring to FIG. 1, there is shown a shoulder pad 10 embodying the invention. As best seen in FIG. 1, the shoulder pad 10 includes an upper sheet 11 of material and a lower sheet 12 of material that are superimposed one on the other and secured to each other about three peripheral edges thereof to define a pocket 13 therebetween. Preferably, the respective upper and lower sheets 11 and 12 are secured about three peripheral edges thereof by a sewn seam to form the pocket 13. However, it will be understood that other securing means may be used to form the pocket; e.g. adhesive, heat bonding, and the like when the sheets are formed of a heat sealable material. It is desirable that the sheets 11 and 12 defining the pocket be formed of a light weight durable material which may be a fabric formed of either natural and/or synthetic fibers. With the pocket 13 so formed, it may be turned inside out as best seen in FIG. 3 so that the peripheral seam 14 is concealed within the pocket 13.

Figure 6:
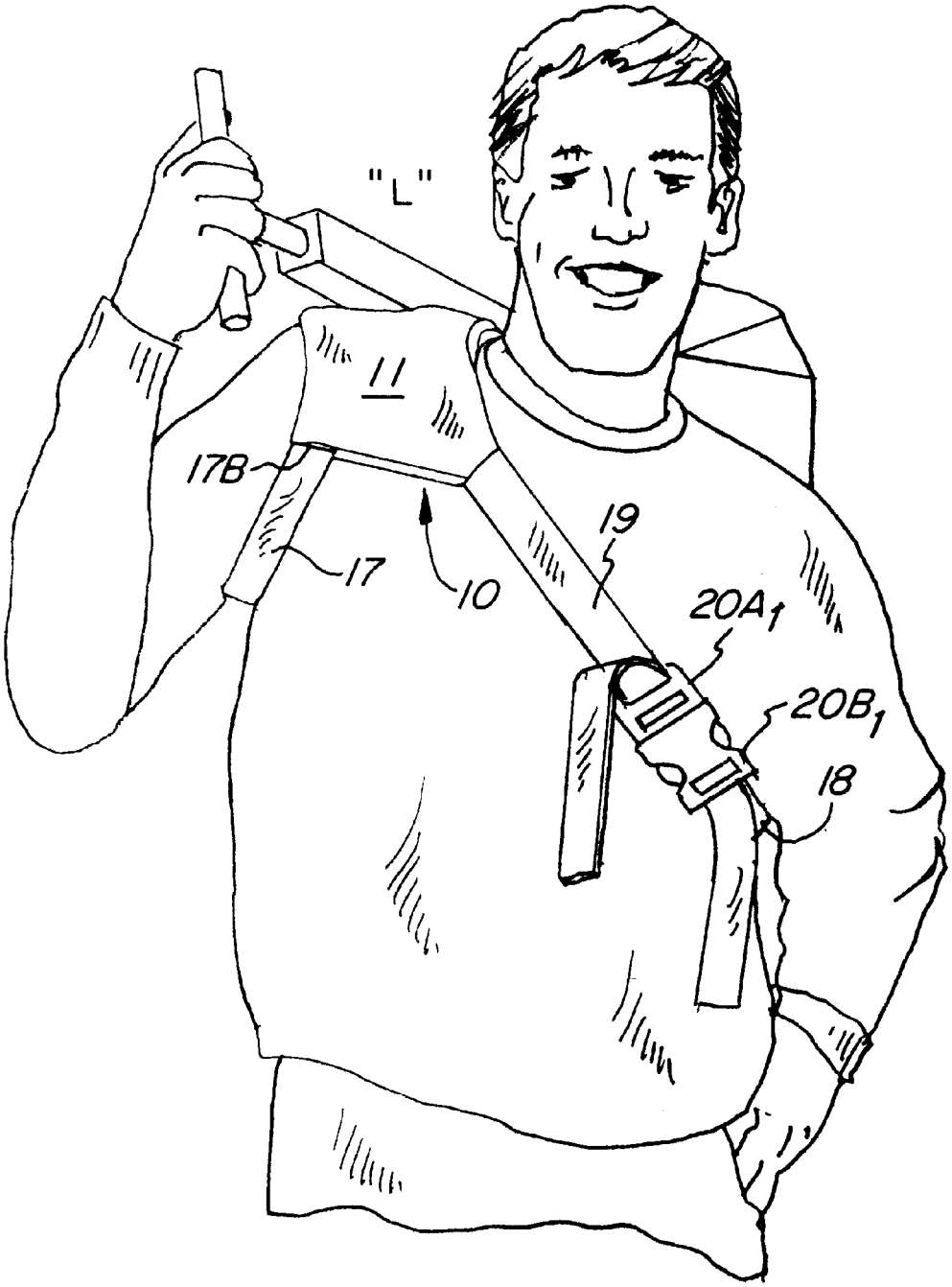
FIG. 6 is a perspective view illustrating the protective pad being worn on the opposite shoulder.

With the pocket 13 so formed, a cushioning material in the form of a pillow or pad, e.g. foam, sponge, or rubber cushion 15 is disposed within the pocket 13 which is thereafter sealed by securing the open end of the pocket 13, e.g. by a sewn seam 16. As shown, the cushion or pad 15 comprises a generally flat member of a suitable thickness to protect the shoulder blade from the direct impact of a load when worn, e.g. as shown in FIGS. 1 and 6. The protective pad thus formed is generally rectangular having opposed side and end portions.

In accordance with this invention, a band 17 has its opposed end portions 17A, 17B secured to the opposed end portions of the shoulder pad 10 adjacent the outer side thereof. As shown, the band 17 defines an underarm loop when worn as shown in FIG. 1. Connected to the inner side portion adjacent the opposed corners of the shoulder pad 10 is a body strap 18 and 19.

Figure 2:
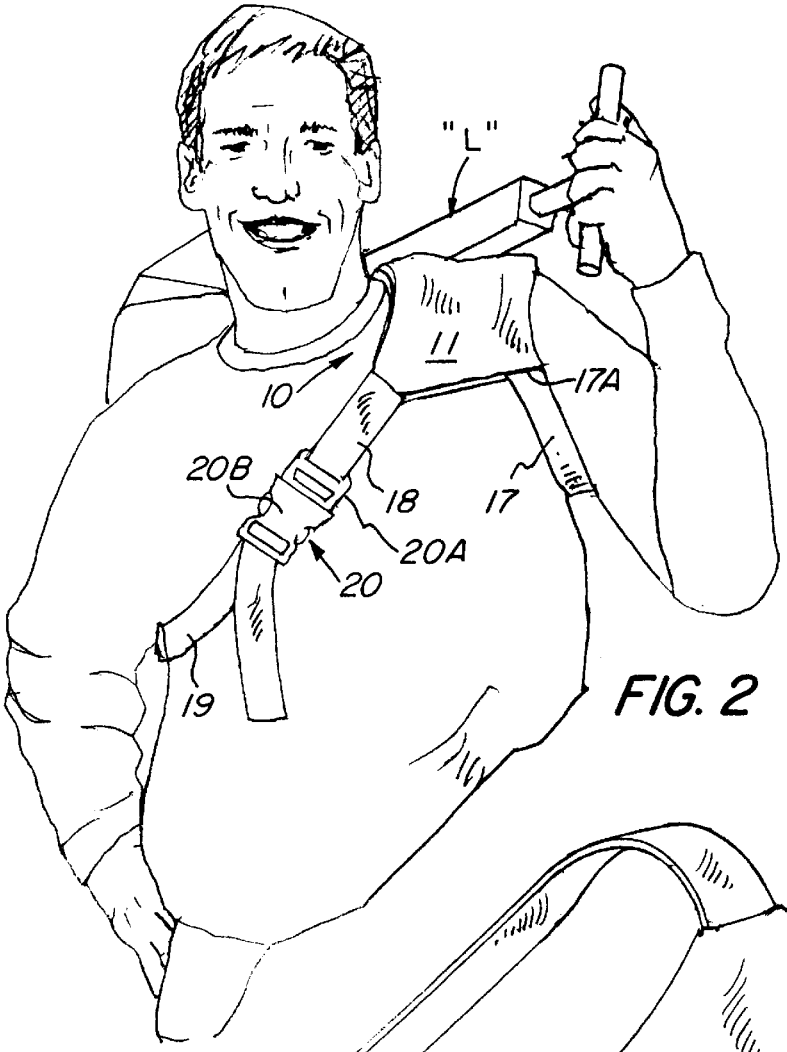
FIG. 2 is a perspective view illustrating how the shoulder pad embodying the invention may be worn.

In the arrangement illustrated in FIGS. 1 and 2, body strap 18 is arranged to extend diagonally across the chest of the wearer and body strap 19 extends diagonally across the back of the wearer and under the other arm to meet body strap 18 in front of the wearer. The opposed ends of the body straps 18 and 19 are provided with a complementary fastening means in the form of a latching buckle 20. The latching buckle 20 illustrated comprises a male latch member 20A connected to the free end of body strap 18 and a female catch member 20B adjustably mounted along the body strap 19. As seen in FIG. 1, when the shoulder pad 10 is to be worn on the left shoulder of a wearer, the left arm is passed through the underarm loop 17 with the body straps 18 and 19 extending diagonally across the body toward the right side so that the back strap 19 passes under the right arm. The arrangement is such that the complementary buckle members 20A, 20B are positioned in the front of the body where they may be readily latched to secure the shoulder pad 10 on the wearer. As the fastener member 20B is adjustable along the body strap 19, it will be understood that the pad can be readily adjustable to fit a wide range of body sizes. Thus, when a large or elongated load "L" is to be carried, it can be readily balanced on the shoulder pad 10, protecting the shoulder from direct contact with the load.

FIG. 6 illustrates the shoulder pad 10 being worn on the opposite or right shoulder of the of wearer. In this form of the invention, the complementary fastening members 20A and 20B are illustrated as being both adjustable along the lengths of the corresponding front and back body straps 19 and 18 respectively. In all other respects, the construction and operation of the shoulder pad 10 is similar to that hereinbefore described.

It will be understood that the shoulder pad 10 is constructed so as to be interchangeably used for protecting either the left or right shoulder to protect against any type of load which is customarily carried on one's shoulder, e.g. skis, lumber, and the like. The shoulder pad is simple in construction and use and can be readily fabricated of existing well known materials. The pad is light in weight and can be readily fitted and secured to the body with a minimum of effort.

While the present invention has been described with respect to a particular embodiment, modifications and variations may be made without departing from the spirit or scope of this invention.

What is claimed is:

1. A protective shoulder pad adapted to be worn on either shoulder of a wearer comprising:

a pair of superimposed sheets of material secured about the peripheral edges thereof to define an open end pocket, a cushioning member disposed within said pocket, and means sealing the open end of the pocket to confine said cushioning member between said superimposed sheets, a band having opposed ends, said pocket having opposed ends and an inner side and an outer side, said opposed ends of said band being secured to said opposed ends of said sealed pocket adjacent said outer side thereof, a front body strap connected to said inner side of said sealed pocket adjacent one corner thereof, and a back body strap connected to said inner side of said pocket adjacent the other corner thereof, and a complementary fastener member connected to the free end of said respective front body strap and back body strap.

2. A protective shoulder pad as defined in claim 1 wherein said complementary fastener member connected to one of said body straps being adjustable along the length of said one body strap.

3. A protective shoulder pad comprising a cushioned pad having opposed side portions and opposed end portions for placement on a wearer's shoulder, a band having opposed ends, said opposed ends of said band being secured to said opposed end portions of said cushioned pad to define an underarm loop adjacent one side portion of said cushioned pad, a pair of body straps, each of said body straps being connected to an opposed end portion of said cushioned pad adjacent to the other of said side portion of said cushioned pad, and means connected to the respective free ends of said body straps for fastening the free ends of said body straps together, wherein one of said body straps extends diagonally across the back of the wearer and the other of said body straps extends diagonally across the front of the wearer, wherein said means for fastening include a complementary catch member and latch member adapted to interlock to function as a readily detachable buckle.

4. A protective shoulder pad as defined in claim 3 wherein at least one of said complementary members is adjustably connected to one of said body straps.

5. A protective shoulder pad as defined in claim 3 wherein each of said complementary members is adjustably positioned along its corresponding body strap.

6. A protective shoulder pad which is adapted to be worn on either shoulder of a wearer comprising:

a pair of generally rectangular sheets of material superimposed on one another and secured on three sides thereof to define a pocket having an open end, a cushioning pad disposed within said pocket, means for securing said open end of said pocket to confine said cushioning pad therein to form a protective pad, said protective pad having opposed side and end portions, a band having opposed end portions, said band having said opposed end portions thereof secured to a corresponding end portion of said opposed end portions of said protective pad to extend traversely of said protective pad adjacent one side of said protective pad, and a body strap connected to each end portion of said protective pad adjacent the opposite side portion of said protective pad, each of said body straps being adapted to extend diagonally across the front and back of the wearer, and a fastening means connected adjacent the free end of each of said body straps, said fastening means including a catch member and a complementary latch member for detachably connecting the free ends of said body straps together when said shoulder pad is worn.

* * * * *